US005918424A

United States Patent [19]

Rice

[11] Patent Number: 5,918,424

[45] Date of Patent: Jul. 6, 1999

[54] ACCOMMODATION UNITS

[76] Inventor: James Rice, 12 Hetherington Way, Ickenham, Uxbridge, Middlesex, United Kingdom, UB10 8AT

[21] Appl. No.: 09/026,756

[22] Filed: Feb. 20, 1998

[30] Foreign Application Priority Data

Apr. 21, 1997 [GB] United Kingdom ..... 9708030
Aug. 21, 1997 [GB] United Kingdom ..... 9717608

[51] Int. Cl.[6] ..... E04B 1/346

[52] U.S. Cl. ..... 52/65; 52/220.8; 52/220.1; 137/580

[58] Field of Search ..... 52/65, 220.1, 220.8; 137/580

[56] References Cited

U.S. PATENT DOCUMENTS

| | | | |
|---|---|---|---|
| 244,358 | 7/1881 | Brown et al. | 52/65 |
| 360,508 | 4/1887 | Brown | 52/65 |
| 390,093 | 9/1888 | Pauly et al. | 52/65 |
| 407,877 | 7/1889 | Rowe | 52/65 X |
| 416,364 | 12/1889 | Hough et al. | 52/65 |
| 2,563,531 | 8/1951 | Kirkman et al. | 52/220.1 X |
| 3,599,378 | 8/1971 | Kachnic | 52/220.1 X |
| 3,636,975 | 1/1972 | Kirkman et al. | 52/65 X |
| 3,905,166 | 9/1975 | Kaiser . | |
| 4,353,608 | 10/1982 | Massau | 52/65 X |

FOREIGN PATENT DOCUMENTS

| | | | |
|---|---|---|---|
| 642617 | 5/1964 | Belgium | 52/65 |
| 0530172 | 3/1993 | European Pat. Off. . | |
| 1500716 | 2/1978 | United Kingdom . | |

*Primary Examiner*—Robert Canfield
*Attorney, Agent, or Firm*—Elliott N. Kramsky

[57] ABSTRACT

The accommodation unit described carries on its underside a circular array of wheels which rest on a circular rail. Mounted on the platform are three separate room units. Each room unit has a generally circular wall and the circumferences of the walls of the three rooms intersect one another to provide a common space between the rooms to allow access to the rooms and to accommodate a central hollow service pillar which is coaxial with the rotary axis of the platform.

7 Claims, 3 Drawing Sheets

ACCOMMODATION UNITS

The present invention relates to accommodation units.

BACKGROUND OF THE INVENTION

Domestic accommodation is usually fixed so that the views from the different windows remains the same. For persons who have to spend considerable time in such units due to incapacity, infirmity or for other reasons this can render life dull and uninteresting particularly as much of the time is to be spent looking out the windows.

DESCRIPTION OF THE PRIOR ART

European Patent No 530 172 discloses a platform rotatably supporting a traditional house. The support structure is of particularly heavy duty and the connection of main services unduly complex.

U.S. Pat. No. 3,905,166 discloses a rotary building which is supported on a non-rotary central tower provided with a stairway to gain access to the building. Again, the structure is highly robust, complex and very expensive.

UK Patent No 1 500 716 discloses a rotary platform for supporting a construction and supplying the construction with mains services. The construction may be solar panels or a sanitarium annex.

None of these arrangements offer a modularised, simplified accommodation unit which is simple and cheap to construct and yet offers all the necessary services required.

It is an object of the present invention to provide an improved accommodation unit.

According to the present invention there is provided an accommodation unit comprising a rotary platform mounted to ride on a circular rail, a group of interconnected room units mounted on the platform, and a service duct coaxial with the axis of rotation of the platform, extending downwardly from the platform to accommodate service conduits to and from the accommodation unit.

Preferably, each room unit has a generally circular wall, the radial centres of the walls being positioned in the platform so that the walls of different units intersect one another and terminate at the point of intersection.

Advantageously, each room unit has a domed roof.

The circular rail has a lateral rack which is engaged by a pinion driven by a motor mounted on the platform.

The platform has a downwardly depending stop member spaced from the axial centre of the platform, the stop member cooperating with a ground supported abutment positioned in the path of the stop member to limit the rotation of the platform to less than 360°.

The service duct accommodates a cylindrical waste water pipe extending downwardly and coaxial with the rotary axis of the platform. The waste water pipe extends into an upstanding coaxial collection pipe to collect the discharge from the waste water pipe and rotary seal means extending between the two pipes to provide a rotary seal between them.

Preferably, the rotary seal is provided by a pair of O-rings.

The service duct also accommodates flexible conduits for other services. The length of the duct being sufficient to allow each duct to be axially twisted through 360° without exceeding the twist specification of the conduit.

BRIEF DESCRIPTION OF THE DRAWINGS

An accommodation unit will now be described, by way of example, with reference to the accompanying diagrammatic drawings, in which.

DETAILED DESCRIPTION OF THE PREFERRED EMBODIMENT

Figure 1:
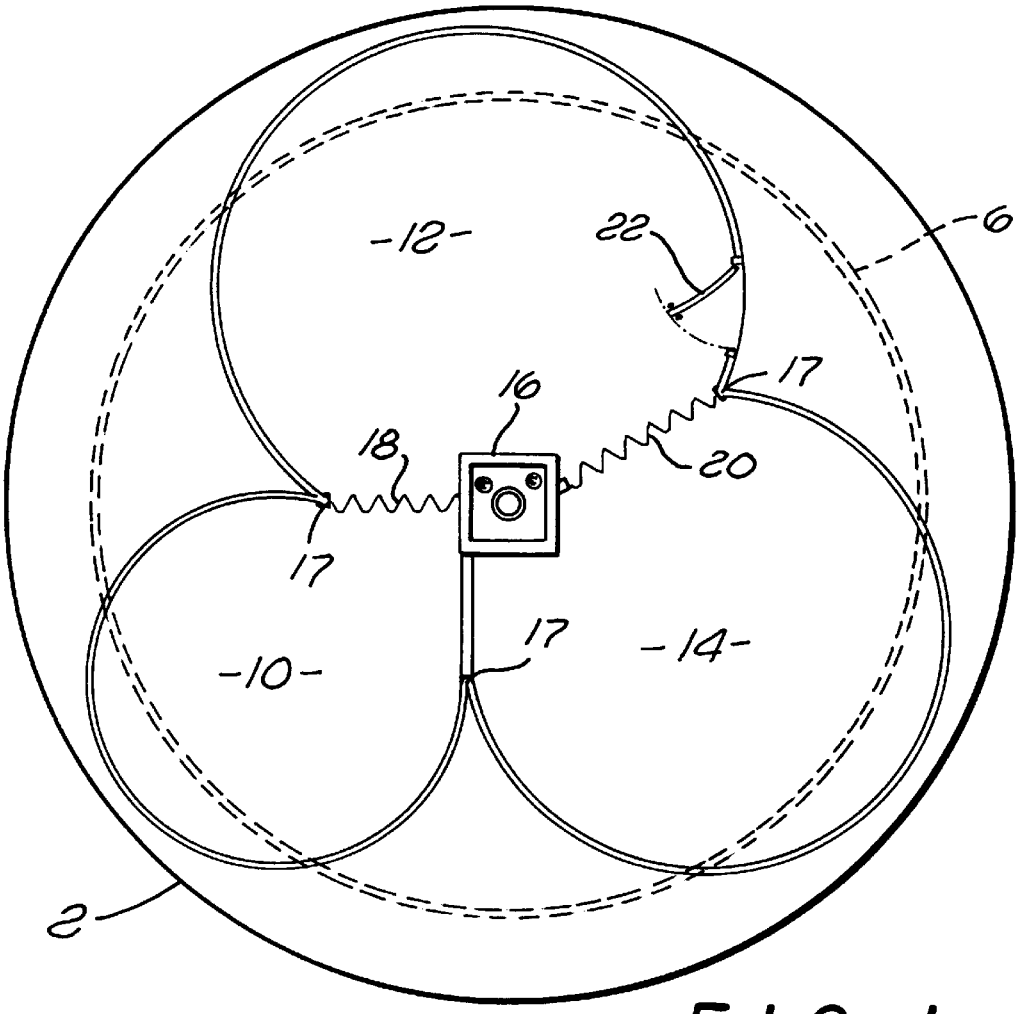
FIG. 1 is a plan view of the accommodation unit.
Figure 3:
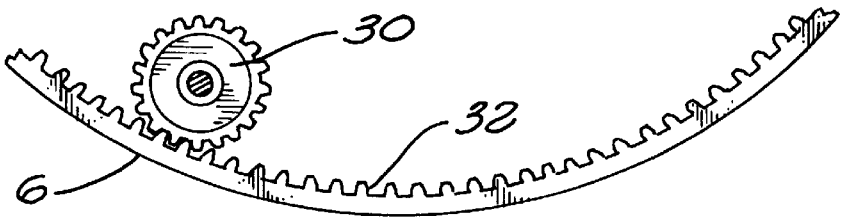
FIG. 3 is a detail of the drive mechanism for the unit.
Figure 2:
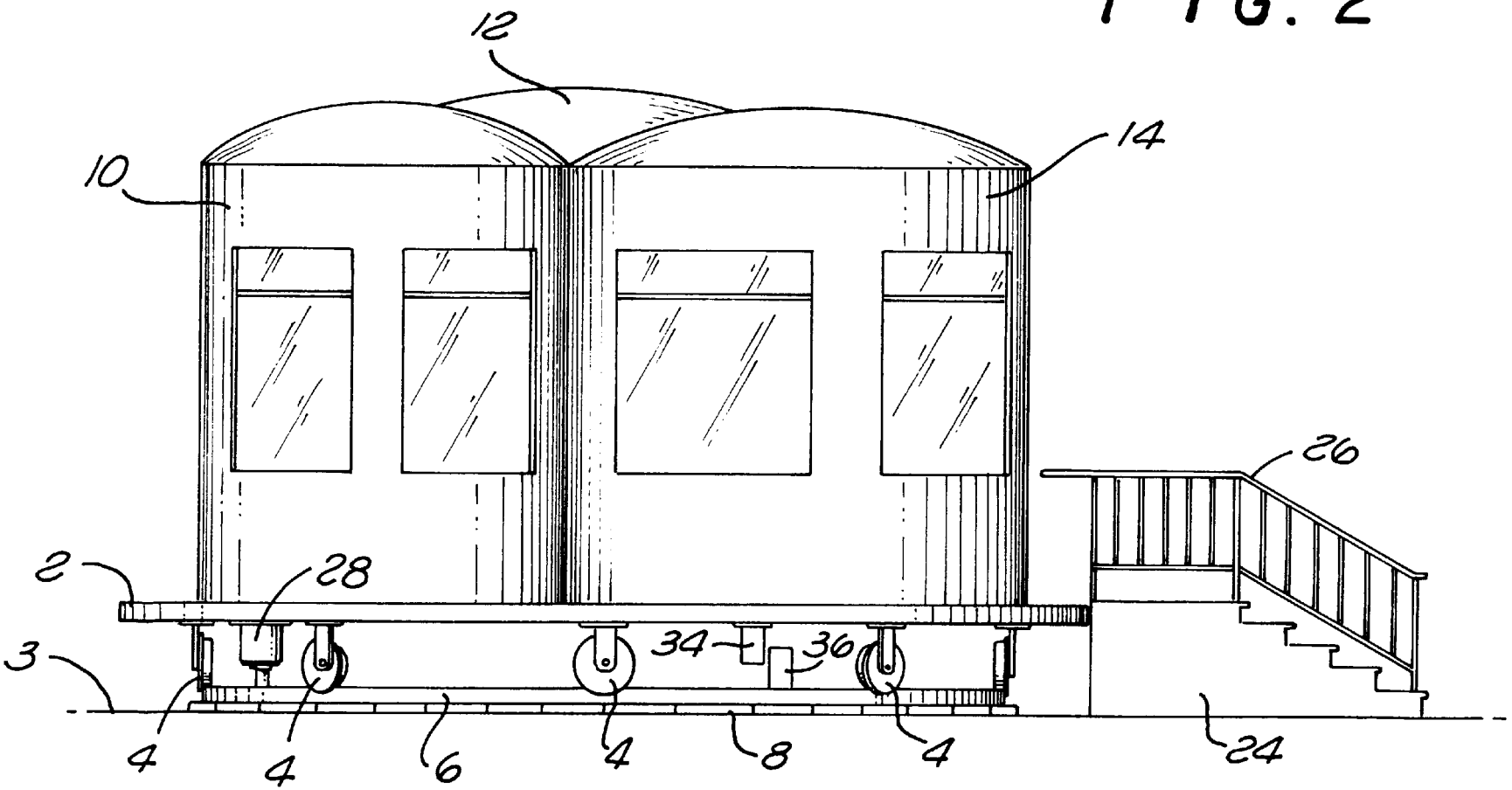
FIG. 2 is a front elevation of the unit of FIG. 1.

The accommodation unit to be described can be used for permanent or holiday accommodation and is of prefabricated construction. The unit can be rotated through up to 360° to change the view from each window as desired or to follow the sun.

The unit comprises a circular platform 2 of wood or reinforced concrete. The platform may be reinforced by equiangularly spaced radially extending ribs (not shown). The platform carries on its underside a circular array of wheels 4 which rest on a circular rail 6. The rail 6 in turn is supported on the ground by sleepers 8. For larger or heavy duty accommodation units, the rails and wheels may be provided in radially spaced pairs.

Mounted on the platform 2 are three separate room units namely a kitchen unit 10, a living room unit 12 and a bedroom unit 14 with an en-suite bathroom or shower (not shown). Each room has a generally circular wall.

The circumferences of the walls of the three rooms intersect one another at 17 to provide a common space between the rooms to allow access to the rooms and to accommodate a central hollow service pillar 16 which is coaxial with the rotary axis of the platform 2.

The circular walls have arcuate windows which are beneficial in giving wide angle views. Furthermore, the provision of rooms in circular modules allows cheap and simple modular construction of three or more rooms on the same platform base and enables them all to be radially connected to the services in the central pillar.

Concertina style doors 18 and 20 enable the kitchen unit 10 to be shut off from the living room unit and the bedroom unit to be shut off from the living room unit. An entrance door 22 is provided on the living room unit wall to allow access to an enlarged external area of space on the platform lying between the living room and bedroom units.

When the rotary position of the platform is in the "home" location, the door 22 faces steps 24 and a handrail 26 which provides access to and from the accommodation unit.

An electric motor 28 mounted on the platform 2 has a pinion 30 which engages a rail 32 on the inner face of the rail 6. Energisation of the motor 28 thus causes the platform 2 and therefore the accommodation unit to be rotated to any desired angular position. A downwardly depending abutment 34 is provided on the underside of the platform. An upstanding ground supported stop 36 is located in the locus of the abutment 34 to limit the rotation of the platform 2 to less than 360°.

For convenience, when the abutment 34 engages the stop 36, this may be considered the "home" position of the accommodation unit.

Each room unit has a domed roof which may be translucent or transparent. Internal shades may be provided to vary the degree of penetration of light into the unit through the roof.

Figure 4:
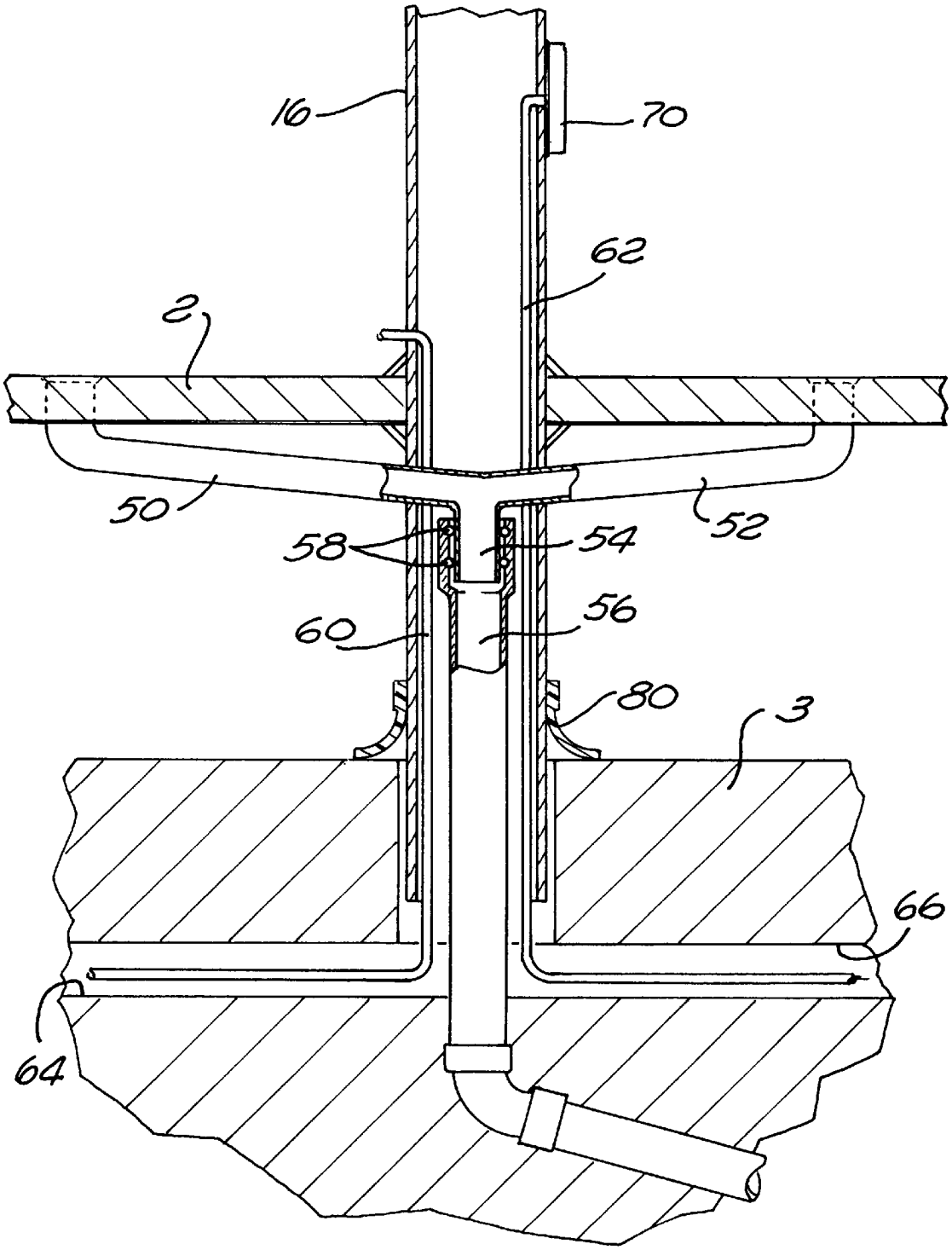
FIG. 4 is a section to an enlarged scale of the service system for the unit.

The provision of services to and from the accommodation unit is more clearly illustrated in FIG. 4. As shown, the service pillar 16 is anchored to the platform 2. Waste water and sewage pipes 50 and 52 feed a T-junction 54 within the pillar 16. The downstream outlet of the T-junction 54 telescopically engages an upstanding waste pipe 56. The radial gap between the two pipes is sealed by a pair of axially spaced O-rings 58 lying in grooves (not shown) which allow the outlet of the T-junction to rotate relative to the waste pipe 56 without breaking the seal between them.

The annular gap between the waste pipe 56 and the pillar 16 accommodates a flexible water pipe or hose 60 and a flexible electric mains cable 62 which are supplied to the pillar 16 via underground ducts 64 and 66 respectively. The length of the pillar 16 between the T-junction and its lower extremity must be sufficient to allow the water pipe 60 and the electric cable to twist through at least 360° without exceeding the twist specification limit of each. The upper end of the pipe 60 is coupled to the on-board water service system of the accommodation unit and the upper end of the electric cable is connected to the on-board distribution unit and fuse box 70.

Other services such a telephone and gas can be supplied in a similar manner.

The perimeter of the platform 2 may supported decorative or guard rails (not shown).

It will be appreciated that the accommodation unit is not limited to three room units more can be provided as required.

The rail 6 is preferably mounted in a reinforced concrete base 3 set in the ground.

The pillar 16 may be provided with a radially outwardly and downwardly directed skirt 80 to prevent ingress of debris into the annular gap between the pillar 16 and the concrete base 3.

Indeed, many alternations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

I claim:

1. An accommodation unit comprising a rotary platform having an axis of rotation, a circular rail, means mounting the platform to ride on said circular rail, a plurality of generally circular walls mounted on the platform to define a group of interconnected room units mounted on the platform, the radial centers of the walls being so positioned that the walls of different room units intersect one another and terminate at the point of intersection, and a service duct supported by the platform to rotate with the platform, the service duct being coaxial with the axis of rotation of the platform, and extending downwardly from the platform to accommodate service conduits to and from the accommodation unit.

2. An accommodation unit according to claim 1, including a domed roof for each room unit.

3. An accommodation unit according to claim 1, wherein the circular rail has a lateral rack and including a motor mounted on the platform, the motor having a pinion which engages the rack to rotate the platform.

4. An accommodation unit according to claim 1, wherein the platform has a downwardly depending stop member spaced from the axial center of the platform, the stop member cooperating with a ground supported abutment positioned in the path of the stop member to limit the rotation of the platform to less than 360°.

5. An accommodation unit rotatable on a circular rail, comprising a rotary platform having an axis of rotation, an array of wheels rotatably supporting the platform on the circular rail, a group of interconnected room units mounted on the platform, a service duct rigid with the platform, positioned coaxially with the axis of rotation of the platform and extending downwardly, a downwardly extending waste water pipe located coaxially within the service duct, an upstanding coaxial collection pipe to collect the discharge from the waste water pipe telescopically coupled to the waste water pipe, rotary seal means extending between the two pipes to provide a rotary seal between them and further flexible service conduits within the service duct, the length of the duct being sufficient to allow each conduit to be axially twisted through 360° without exceeding the twist specification of that conduit.

6. An accommodation unit rotatable on a circular rail, comprising a rotary platform, an array of wheels rotatably supporting the platform on the circular rail, a group of interconnected room units mounted on the platform, a service duct rigid with the platform, positioned coaxially with the axis of rotation of the platform and extending downwardly, a downwardly extending waster water pipe located coaxially within the service duct, an upstanding coaxial collection pipe to collect the discharge from the waste water pipe telescopically coupled to the waste water pipe, rotary seal means extending between the two pipes to provide a rotary seal between them, and each said room unit is generally circular and said room units intersect to provide a common space.

7. An accommodation unit according to claim 6, wherein each said room unit has a domed roof.

* * * * *